United States Patent [19]

Baugh

[11] Patent Number: 4,899,837

[45] **Date of Patent: * Feb. 13, 1990**

[54] MUD SAVER VALVE

[75] Inventor: Benton F. Baugh, Houston, Tex.

[73] Assignee: Citizens Bank, Corpus Christi, Tex.; Trustee for C & S Specialty, Inc.; Pension Plans (for the Benefit of James R. Cameron)

[ * ] Notice: The portion of the term of this patent subsequent to Oct. 25, 2005 has been disclaimed.

[21] Appl. No.: 128,681

[22] Filed: Dec. 4, 1987

Related U.S. Application Data

[63] Continuation of Ser. No. 888,259, Jul. 23, 1986, Pat. No. 4,779,688.

[51] Int. Cl.[4] ..... E21B 21/10

[52] U.S. Cl. ..... 175/218; 137/493; 137/508; 166/325

[58] Field of Search ..... 175/218, 232, 234, 237, 175/317; 166/325, 329; 137/493, 508

[56] References Cited

U.S. PATENT DOCUMENTS

| | | | |
|---|---|---|---|
| 3,698,426 | 10/1972 | Litchfield et al. | 137/512.1 |
| 3,750,749 | 8/1973 | Giroux | 166/95 |
| 4,128,108 | 12/1978 | Parker et al. | 137/327 |
| 4,248,264 | 2/1981 | Hadsell et al. | 137/454.2 |
| 4,364,407 | 12/1982 | Hilliard | 137/71 |
| 4,625,755 | 12/1986 | Reddoch | 137/327 |
| 4,658,905 | 4/1987 | Burge | 166/325 X |
| 4,779,688 | 10/1988 | Baugh | 175/218 |

*Primary Examiner*—Jerome W. Massie, IV
*Assistant Examiner*—David J. Bagnell
*Attorney, Agent, or Firm*—Gunn, Lee & Miller

[57] ABSTRACT

A mud valve assembly is disclosed having a valve member with a first sealing surface and a piston member with a second sealing surface which seals against the first sealing surface such that the piston and the first sealing surface move downward in response to pressure from above which exceeds a predetermined pressure level and the valve member and the second sealing surface move upward in response to pressure from below the valve assembly. The valve member with the second sealing surface can be retrieved from the bore of the drill pipe and reinstalled into the bore of the drill pipe without removing the mud valve assembly from the drill pipe.

7 Claims, 2 Drawing Sheets

MUD SAVER VALVE

This is a continuation of application Ser. No. 06/888,259 filed July 23, 1986 now U.S. Pat. No. 4,779,688.

BACKGROUND OF THE INVENTION

The field of invention of this valve pertains to valves and more particularly to a valve assembly of the type known as a kelly foot valve or a mud saver valve used in the rotary system for drilling oil wells.

Conventional drilling of oil wells uses the a drill string or sections of drill pipe to pump drilling mud down to a drilling bit at the bottom of the hole being drilled. The drill string also typically is rotated to provide rotary power to the drilling bit at the bottom of the hole. As the hole is progressively drilled deeper and deeper, sections of drill pipe are added to the drill string to allow continued drilling. These sections are typically 30 feet long. The wells are typically from 1000 to 20,000 feet deep. The drill string is supported in the rotary table of the rig and the upper drive section or kelly is unscrewed. When it is unscrewed, the mud in the kelly and the hose connecting the top of the kelly to the other piping on the rig pours out onto the rig floor.

The pouring of the drilling mud onto the rig floor is expensive because of the cost of the mud and is dangerous to the rig crew as it makes the floor slippery.

Prior art valves have been inserted into the drill string at the foot or lower end of the kelly with different characteristics and with different degrees of success. One solution has been to place a slim O.D. ball valve in the string which is operated manually by the crew.

Other valves have been added which operate automatically based upon bore pressure or upon throttling of the fluid across the valve. These valves and the valve of the present invention are typically installed in a sub called a Kelly Saver. The term Kelly Saver comes from the fact that the section of square pipe at the top of the drill pipe which is engaged by the rotary table to turn the drill pipe is call the Kelly. Each time 30 feet more of the well is drilled, the connection at the bottom of the Kelly is unscrewed and a joint of drill pipe is added to allow further drilling. This causes high wear and reduced life on the relatively expensive Kelly. A short inexpensive section of pipe is normally added to the bottom of the Kelly to take this wear and is typically called a Kelly Saver.

Prior art valves characteristically do not allow the bore thru the valve to be opened for service access down into the string of drill pipe and then put back into service without having to disassemble the mud saver valve from the drill string to put it back together. Some of the alternatives, i.e. U.S. Pat. Nos. 3,698,411 and 3,965,980 require breaking a cap portion at the top of the valve to allow such service. U.S. Pat. No. 4,128,108 discloses a mud saver valve which requires that a pin be sheared to allow such service. U.S. Pat. No. 3,331,385 discloses a valve in which an extra part is added with special running tools to allow opening and then plugging the bore. This provides the limitations of making the hole available for servicing smaller, adding extra parts, and not allowing the critical wear surfaces to be retrieved easily for inspection and/or replacement.

A second problem associated with prior art valves is that of allowing any pressure build-up below the mud saver valve to be sensed by pressure gages above the mud saver valve. This might occur when the mud is not being pumped. If unstable well conditions exist in which a blowout threatens, watching the pressure in the drill pipe above this valve is critical in the process of knowing how to control the well. Typical prior art valves such as those listed above include added components to act as check valves to allow flow in the direction going up the well.

SUMMARY OF THE INVENTION

The object of the present invention is provide a mud valve assembly including a valve means which seals against a piston means and prevents flow out of the kelly portion of the drill pipe string above the rotary table or working level on a rotary drilling oil rig under the low head pressures associated with unscrewing the drill pipe at the rotary table or working level, but will cause the piston to move down and allow free flow under the higher pressures and flow rates which normally exist under drilling conditions, which will allow the valve means to move up freely to vent pressure from below the valve means to the area above the valve means for pressure sensing by rig personnel, and further which will allow the complete removal and reinstallation of the valve means with its seal area for downhole servicing work thru the drill string without having to remove the mud valve assembly from the drill pipe.

DESCRIPTION OF THE PREFERRED EMBODIMENT

Figure 1:
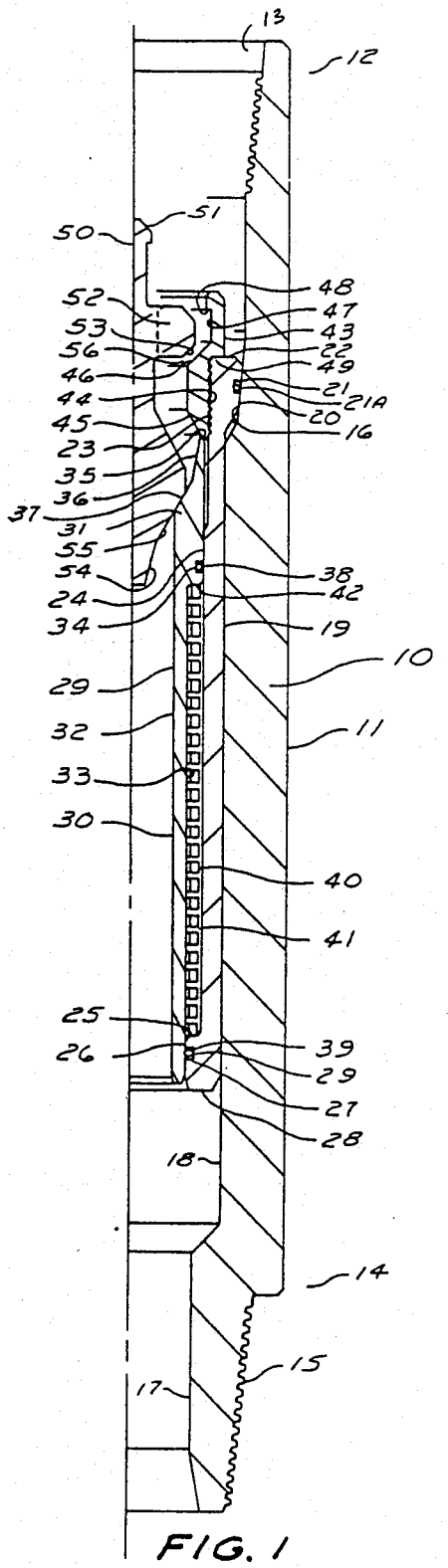
FIG. 1 is a quarter section of the mud valve assembly of this invention in the first position which is closed and not allowing flow thru the valve.

Referring now to FIG. 1, the mud valve assembly 10, is contained within a section of drill pipe 11 which is normally called a Kelly Saver. The upper end of the Kelly Saver 12 has a female drill pipe thread 13 for connection to the Kelly and the lower end 14 has a male drill pipe thread 15 for connection to the top of the string of drill pipe extending down into the well being drilled.

A tapered shoulder 16 is in the upper end of the Kelly Saver 11 for supporting the mud saver valve 10. The bore 17 of the Kelly Saver 11 is the normal thru bore which would exist in a sub of this type, and the bore 18 is an enlarged bore in the sub machined out to accommodate the mud saver valve assembly 10.

Tubular body 19 includes and outer tapered shoulder portion 20 which lands on the tapered shoulder 16. Tapered shoulder 20 includes a seal groove 21 and a seal ring 21A which seal against the tapered shoulder 16. Tapered body 19 also includes a top shoulder 22, an internal female thread 23, a seal bore 24, an internal shoulder 25, a reduced bore 26, a seal groove 27, and a lower end 28.

Piston means 29 includes a long straight portion 30 and an enlarged portion 31. The bore 32 of the piston means 29 preferably matches the bore 17 of the Kelly Saver 11. Piston means 29 further provides a seal surface 33, a seal groove 34, an upper shoulder 35, a first tapered surface 36, and a second tapered surface 37 which will also be called the first seal area 37.

Seal ring 38 fits into seal groove 34 and seals against seal bore 24. Seal ring 39 fits into seal groove 29 and seals against seal surface 33.

Spring 40 fits into the cavity 41 between the tubular body 19 and the piston means 29 and pushes up against shoulder 42 on the piston means 29 and reacts against the shoulder 25 on the tubular body 19. The cavity 41 is a sealed cavity with the difference in the areas of the seal bore 33 and the seal bore 24 acting as a piston area subjected to the pressures within the drill pipe. Under sufficient pressure, this piston area will cause the piston means to move against the spring loading and move down until a stop is encountered. In the case of the preferred embodiment, the spring 40 is made of a square wire and stops the movement of the piston means 19 when it reaches stack height.

Stop body 43 provides a male thread 44 to engage the female thread 23 of the tubular body 19, a lower tapered shoulder 45, an upper tapered shoulder 46, and internal profile 47 and an internal shoulder 48. The lowered tapered shoulder 45 is engaged by the upper shoulder 35 of the piston means 29 to act as the upper stop in the movement of the piston means 29. The internal profile 47 with the internal shoulder 48 is intended for removal of the valve assembly from the Kelly Saver 11. Shoulder 49 provides a stop shoulder against shoulder 22 when screwing the stop body 43 into the tubular body 19.

Valve means 50 provides retrieval profile 51, arms 52, shoulders 53 on the arms 52, a first tapered surface 54, and a second tapered surface 55 which will also be referred to as second sealing surface 55. Seal surface 55 is contacting and sealing against seal surface 37 in the position as shown. In this case sealing refers to preventing of substantial flow and is not intended to require "drop tight" sealing. It is relevant to notice that when the connection 15 is unscrewed, all of the fluids inside the valve are going to spill out. It is the additional gallons above the valve means 19 in the Kelly which this valve is intended to keep from spilling on the rig floor.

As pressure in increased from the top, the combination of the valve means 50 and the piston means 29 will move down until the gap 56 between the shoulders 53 and 46 is closed. At that time the valve means 50 is prevented from moving down further. Additional pressure will cause the piston means 29 to move down against the spring force and therefore cause a separation in the seal surfaces 55 and 37. As the combination of pressure and flow increase, the piston means 29 will be moved fully down to its lower position and the valve will be fully open.

When the flow is stopped and the pressure is vented, the valve means and piston means will return to the position as shown on this figure.

Figure 2:
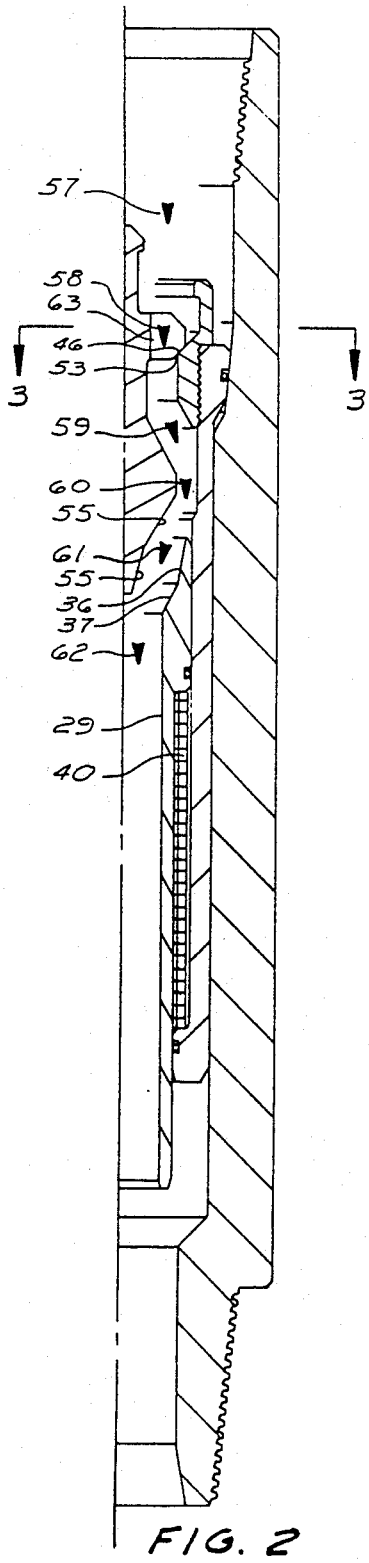
FIG. 2 is a quarter section of the mud valve assembly in the position in which it will assume under flowing conditions.

Referring now to FIG. 2, arrows 57 thru 62 indicate the flow path thru the assembly when under flowing conditions. The piston means 29 has moved fully down and the spring 40 is at its stack height. The valve means 50 has landed at its lowest position with the shoulder 53 contacting the shoulder 46.

Arrow 58 is is shown going thru the flow area 63 between the arms 52 of the valve means 50. The double tapers 36 and 37 and the double tapers 54 and 55 are shown to be instrumental in providing a relatively smooth flow path thru the valve to minimize turbulence and thereby promote longer service life without erosion.

The force of the flow plus the pressure against the piston area at the top of the piston means 29 are keeping the piston means in the fully opened position. When these forces diminish below a minimum level, the piston means will return to the position as shown in the FIG. 1.

Figure 3:
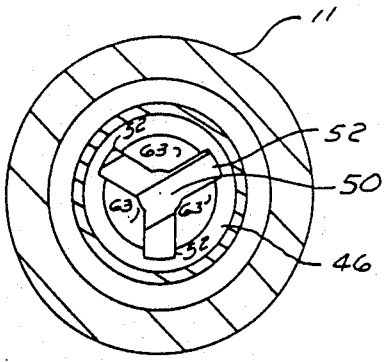
FIG. 3 is a cross section thru the mud valve assembly taken thru the lines 3—3 on FIG. 2.

Referring now to FIG. 3, valve means 50 is shown with the flow areas 63 between the arms 52. This illustrates how the shoulder 46 can be contacted by the shoulder 53 (not shown) as a stop and still allow ample area for flow past the valve member 50.

Figure 4:
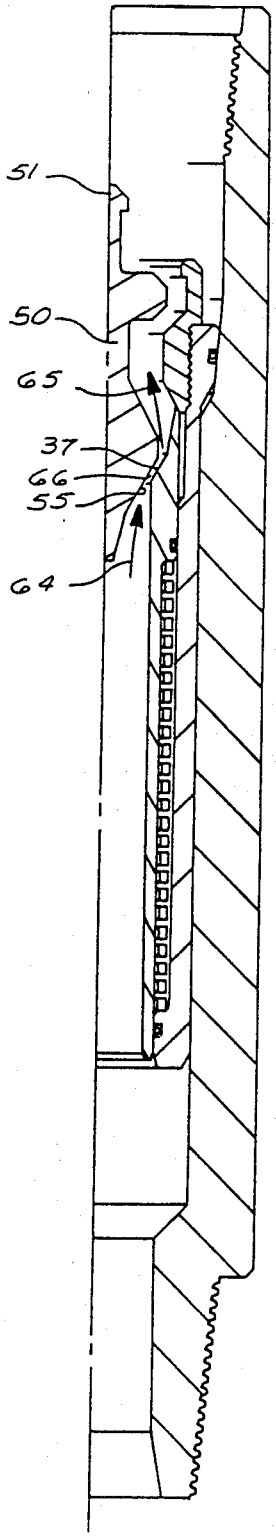
FIG. 4 is a quarter section of the mud valve assembly showing flow in the reverse direction from below the valve means to above the valve means.

Referring now to FIG. 4, flow of fluids is shown to be coming up from the drill string into the kelly by arrows 64 and 65. This flow has lifted the valve means 50 up so that the second sealing surface 55 has been separated from the first sealing surface 37 and caused a gap 66.

The valve means 50 will stay in this slightly elevated position as long as flow exists from the drill string. This is essential so that the drilling personnel on the rig floor can monitor the pressures within the well when the pumps are not pumping as in normal drilling.

In like manner the valve means 50 can be simply retrieved from the bore by tools readily available on the drilling rigs which will engage the retrieval profile 51.

The present embodiment reflects a sealed spring cavity 41 which provides the benefits of fully opening the valve due to pressure even at low flow rates and keeps the spring area clean and free from drilling mud. The valve can also be manufactured without the lower seal 39 being in place. This style depends strictly upon throttling across the seat area to provide the force to keep the valve open and would be completely workable, although it would tend to have a shorter service life.

The foregoing disclosure and description of this invention are illustrative and explanatory thereof, and various changes in the size, shape, and materials, as well as the details of the illustrated construction may be made without departing from the spirit of the invention.

I claim:

1. A mud saver valve for retaining drilling fluid in the kelly of a rotary drilling rig, comprising:

(a) a kelly sub defining an open-ended elongated body having threaded ends for forming a connection between the kelly and a drill pipe string;

(b) an enlarged bore formed in said elongated body;

(c) a tubular body received within said enlarged bore of said elongated body, said tubular body including an enlarged portion defining a shoulder for engagement with a shoulder formed in said elongated body;

(d) hollow piston means axially disposed within said tubular body, said piston means being axially movable relative to said tubular body and defining a fluid passage therethrough;

(e) valve means removably mounted within said tubular body, said valve means cooperating with said piston means to normally close the fluid passage through said piston means, wherein said valve means is movable between a first and second position;

(f) a stop member removably connected to said tubular body, said stop member including a first internal circumferential tapered shoulder for limiting downward movement of said valve means; and (g) means for urging said piston means into engagement with said valve means.

2. The apparatus of claim 1 wherein said stop member includes a second internal tapered circumferential shoulder for limiting upward movement of said piston means.

3. The apparatus of claim 1 wherein said means for urging said piston into engagement with said valve means comprises a spring means disposed between a lower shoulder formed at the lower end of said tubular body and an external circumferential shoulder formed on said piston means.

4. The apparatus of claim 1 wherein said valve means includes a retrieval profile for engagement by a retrieval tool for removal of said valve means from said tubular body.

5. The apparatus of claim 1 wherein said valve means comprises a valve element having a valve stem extending therefrom, said valve stem including a plurality of arms extending radially outwardly therefrom, said plurality of arms defining flow paths therebetween permitting drilling fluid to flow past the said valve stem.

6. The apparatus of claim 1 wherein said valve means is forced upwardly under the pressure of fluid flow from the drill pipe string permitting the drill pipe string to be vented.

7. A mud saver valve for retaining drilling fluid in the kelly of a rotary drilling rig, comprising:

(a) a kelly sub defining an open-ended elongated body having threaded ends for forming a connection between the kelly and a drill pipe string;

(b) an enlarged bore formed in said elongated body;

(c) a tubular body received within said enlarged bore of said elongated body, said tubular body including an enlarged portion defining a shoulder for engagement with a shoulder formed in said elongated body;

(d) hollow piston means axially disposed within said tubular body, said piston means being axially movable relative to said tubular body and defining a fluid passage therethrough;

(e) valve means removably mounted within said tubular body, said valve means cooperating with said piston means to normally close the fluid passage through said piston means, wherein said valve means comprises a valve element having a valve stem extending therefrom, said valve stem including a plurality of arms extending radially outwardly therefrom, said plurality of arms defining flow paths therebetween permitting drilling fluid to flow past said valve stem;

(f) a stop member removably connected to said tubular body, said stop member including a first internal circumferential tapered shoulder for limiting downward movement of said valve means; and (g) means for urging said piston means into engagement with said valve means.

* * * * *